United States Patent [19]

Wilson

[11] Patent Number: 4,515,202

[45] Date of Patent: May 7, 1985

[54] ENVIRONMENTAL CURTAIN

[76] Inventor: Bradford W. Wilson, 1642-A Coriander, Costa Mesa, Calif. 92626

[21] Appl. No.: 97,483

[22] Filed: Nov. 26, 1979

[51] Int. Cl.[3] ..... A47H 13/00; A47H 23/05

[52] U.S. Cl. ..... 160/332; 160/388

[58] Field of Search ..... 160/332, 130, 181, 184, 160/388, DIG. 8, 236, DIG. 15; 24/16 PB, 30.5 P, 73 CH, 265 R

[56] References Cited

U.S. PATENT DOCUMENTS

| | | | |
|---|---|---|---|
| 370,239 | 9/1887 | Brombacher | 24/16 PB X |
| 3,224,054 | 12/1965 | Lige | 24/16 PB |
| 3,468,050 | 9/1969 | Pool | 24/16 PB |
| 4,033,396 | 7/1977 | Thomasset | 160/332 |
| 4,095,642 | 6/1978 | McKinnon et al. | 160/332 |

FOREIGN PATENT DOCUMENTS

| | | | |
|---|---|---|---|
| 144921 | 12/1948 | Australia | 211/89 |
| 2311595 | 9/1973 | Fed. Rep. of Germany | 160/332 |
| 556449 | 7/1923 | France | 24/16 PB |
| 1287513 | 2/1962 | France | 160/332 |
| 346341 | 3/1931 | United Kingdom | 24/16 PB |
| 1057882 | 2/1967 | United Kingdom | 24/16 PB |

*Primary Examiner*—Rodney H. Bonck

*Attorney, Agent, or Firm*—Gordon L. Peterson

[57] ABSTRACT

An environmental curtain for closing a doorway, including elongated, flexible strips having their upper ends formed into loops and a curtain support extending through the loops to suspend the flexible strips within the doorway. The upper end portion of at least one of the flexible strips has a head, a neck which is narrower than the head, and an opening. The head can be inserted through the opening to place the neck within the opening to quickly and easily form the upper end portion of that flexible strip into a loop.

2 Claims, 6 Drawing Figures

ENVIRONMENTAL CURTAIN

BACKGROUND OF THE INVENTION

The door to large commercial freezers, refrigerators and warehouses must be left open or opened many times each day in order to permit the movement of personnel and material handling equipment through the door. Whenever the door is opened or left open, there is an energy loss due to heat transfer between the cold or warm area inside and the ambient conditions outside.

To reduce this energy loss and to provide other advantages, environmental curtains are commonly used to close the opening leading to a controlled environmental zone. An environmental curtain typically includes elongated flexible plastic strips having their upper ends formed into loops and a curtain support extending through the loops. The curtain support is mounted in the doorway to suspend the flexible strips in the doorway in side-by-side overlapping relationship. In this manner, the doorway remains closed, except when personnel or equipment are passing through, and in this event, the strips are only pushed aside to the extent necessary for passage of the personnel or equipment.

Although environmental curtains of this type function very satisfactorily, they are somewhat difficult to install on the curtain support. According to one prior art technique, the upper end of each flexible strip is permanently heat-welded to form a loop through which the curtain support can be extended. One problem with this construction is that the strips are difficult to install because the curtain support must first be detached at one end to allow the loops to be slid over the free end of the curtain support.

Another prior art technique utilizes separate threaded fasteners to form the upper ends of the flexible strips into loops. The fasteners can be removed. However, the use of separate fasteners adds to the cost of installation and requires more time to install the strips than is desirable.

All of these prior art constructions provide loops of very substantial strength for each of the flexible strips. Although strong construction is desirable, it is a distinct disadvantage when the lower end of one of the strips becomes inadvertently attached to a vehicle, such as a forklift truck, moving through the doorway. In this event, the entire strip door, including the curtain support and all of the strips can be pulled down. This is a potential source of injury to personnel and damage to equipment.

SUMMARY OF THE INVENTION

This invention provides a strip curtain, such as an environmental curtain, in which the upper ends of the strips are formed into loops without separate fasteners and the loops thus formed are not permanent. The loops can be easily formed and undone, and this facilitates the installation and removal of the strips.

With this invention, the upper end portion of the elongated flexible strip has an opening spaced from the upper end of the strip by an upper segment of that strip. The upper segment of the flexible strip has a head and a neck of less width than the head, with the neck being between the head and the opening. The head is insertable through the opening to place the neck into the opening and to form the segment into a loop for receiving the curtain support. The head is wider than the opening so that the strip must be distorted to insert the head through the opening and to withdraw the head from the opening. In this manner, the upper end portion of the flexible strip can be quickly and easily formed into a loop by a single workman without using separate fasteners or any tools.

Although the opening in the strip can take different forms, it advantageously includes a slit which forms a major portion of the opening. The slit is preferred because it can more tightly hold the neck in position to form a sturdier loop. If desired, the ends of the slit can terminate in holes which tend to prevent tearing of the flexible strip beyond the ends of the opening.

Because the head is wider than the opening, it cannot be easily inadvertently withdrawn from the opening. In a preferred construction, the head has laterally extending shoulders contiguous the neck. The ease of withdrawing the neck through the opening can be varied by the slope, if any, given to the shoulders.

In a preferred construction, the head terminates at the upper end of the flexible strip. The head preferably has inclined edges which slope away from each other as they extend toward the neck. These inclined edges facilitate the insertion of the head through the opening.

The neck performs several important functions. First, it cooperates with the head to define shoulders which are utilized to prevent withdrawal of the head from the opening. Secondly, by sizing the neck to be somewhat snugly received within the opening, the neck cooperates with the opposite ends of the opening to make the loop sturdier. For example, the neck may have side edges which are closely adjacent the opposite ends of the opening when the neck is in the opening. Third, the neck is of a length which permits it to be slid longitudinally within the opening. The neck is sufficiently long so that it can facilitate insertion of the head through the opening. Specifically, the neck allows easy folding of the head so that it can be inserted through the opening.

If desired, multiple openings can be provided. This permits the size of the loop to be adjusted to suit different mounting conditions. In addition, the end of the head can be tucked into the opening which is not being used for loop formation to provide a neater overall appearance and to increase the strength of the joint. Also, the strip may be divided into two or more upper end portions with each of the upper end portions having its own head, neck and opening so that two separate loops may be provided on the same strip. This construction may be advantageous, for example, on a very wide flexible strip.

Another important feature of this invention which can be used independently of, or in combination with, the features described above is that at least the lower portion of a strip can be pulled from the strip curtain without pulling down the entire strip curtain from the supporting structure. To accomplish this, the predetermined force is less than the pulling force on the strip which is required to pull the curtain support down. Thus, if a forklift truck becomes attached to one of the strips, at least the portion of that strip below the upper end portion thereof will fall from the curtain support in response to a pulling force on such strip of at least about a predetermined magnitude.

Although the releasable means that provides this automatic releasing function can take different forms, it is preferred to make such releasable means responsive to a pulling force of at least about a predetermined magnitude on a strip for opening the loop of that strip. If the releasable means is of this type, the curtain support is preferably attached to the supporting structure by attaching means which spaces the curtain support over a major portion of its length from the supporting structure. This prevents the loop from being clamped tightly against the supporting structure by the curtain support because if it were, the opening or releasing of the loop may not be as effective as desired in releasing the strips from the curtain support.

The head and opening structure described above for the upper end portion of the strip can advantageously be used to provide the necessary releasable means. For example, the releasable means may include the head being withdrawable through the opening in response to a pulling force of about the predetermined magnitude on the associated strip. The withdrawal force can be varied, not only by the slope, if any, given to the shoulders as indicated above, but also by various factors, such as the relative sizes of the opening, the stiffness of the flexible strip and the coefficient of friction of the flexible strip.

The invention, together with further features and advantages thereof, may best be understood by reference to the following description taken in connection with the accompanying illustrative drawing.

DESCRIPTION OF THE PREFERRED EMBODIMENT

Figure 1:
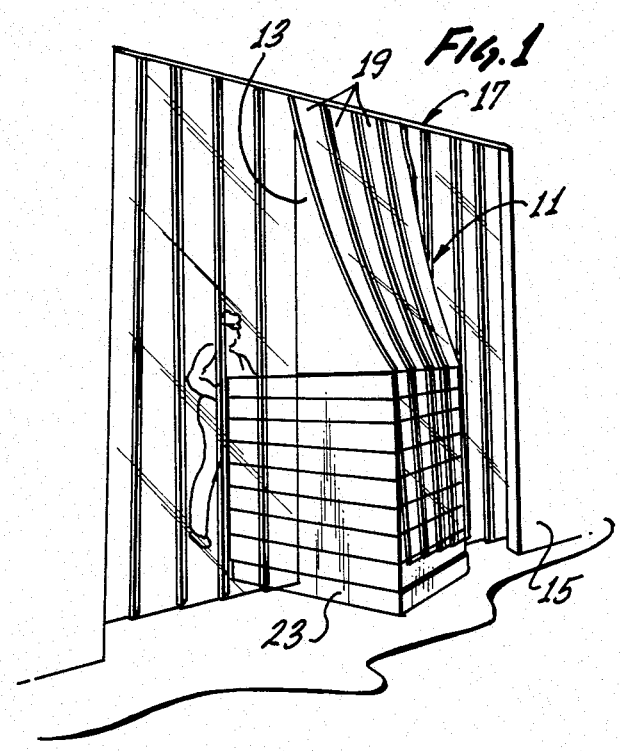
FIG. 1 is an isometric view of an environmental curtain constructed in accordance with the teachings of this invention.
Figure 3:
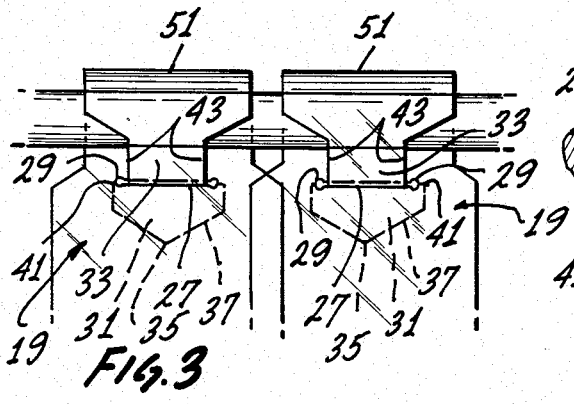
FIG. 3 is a fragmentary front elevational view of two adjacent flexible strips of the curtain with the loops locked in position.

FIG. 1 shows a strip curtain in the form of an environmental curtain 11 employed to close a doorway 13 or other opening in a wall 15 of a freezer 17. For example, the freezer 17 may be within a building or a truck. The environmental curtain 11 includes elongated, flexible strips 19 suspended by a curtain support of a suitable configuration, such as a bar 21 which extends horizontally across the top of the doorway 13. The strips 19 completely close the doorway and are arranged in side-by-side overlapping relationship as shown in FIG. 3. Because the strips 19 are flexible, they are easily pushed aside by personnel or equipment, such as a dolly 23.

Figure 2:
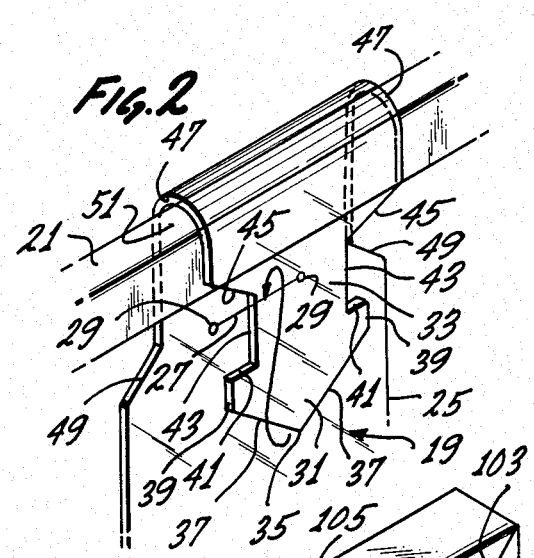
FIG. 2 is a fragmentary isometric view of one of the flexible strips of the curtain with the curtain support shown in phantom lines and with the upper end portion of the strip formed into a loop but not locked in position.
Figure 4:
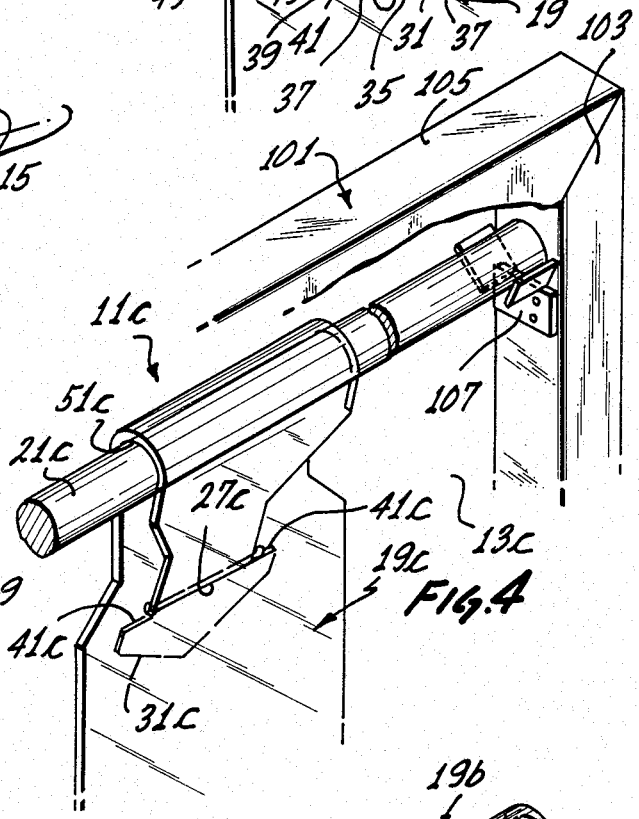
FIG. 4 is a fragmentary isometric view showing the environmental curtain mounted on a curtain support in the form of a rod spaced from the adjacent supporting structure.

Each of the strips 19 is constructed of a flexible transparent material. Although a flexible plastic, such as vinyl, is preferred for many applications, other materials, such as cloth, can be used. As shown in FIGS. 2–4, each of the strips 19 has longitudinally extending parallel side edges 25 and an opening in the form of a slit 27 adjacent the upper end portion of the strip. The slit 27 terminates at its opposite ends in holes 29.

The strip 19 terminates at its upper end in a head 31 and a neck 33 which is narrower than the head and joins the head to the remainder of the strip. The head 31 terminates at its upper end in a point 35 and has inclined edges 37 which slope away from each other as they extend toward the neck 33. The head also has parallel side edges 39 which are parallel to the side edges 25 and laterally extending shoulders 41 which join the side edges 39 to the neck 33. In the embodiment illustrated, in FIGS. 2–3 the shoulders 41 are perpendicular to the side edges 39 and 25. All corners of the strip 19 are preferably rounded to reduce the likelihood of tearing.

The neck 33 has parallel side edges 43 which are also parallel to the side edges 25 and 39. The side edges 43 are joined to outwardly sloping edges 45 which blend into parallel side edges 47. Sloping edges 49 join the side edges 25 to the side edges 47.

To install the strips 19 on the bar 21, it is not necessary to remove the bar 21 or to detach one end of the bar. Rather, with the bar mounted in its normal position above the doorway 13, the head 31 can be folded about a longitudinally extending line and inserted through the slit 27 until the neck 33 lies within the slit as shown in FIG. 3. This forms a loop 51 around the bar 21. In this position, the shoulders 41 lie essentially along the same line as the slit 27 and prevent withdrawal of the head 31 from the slit. The side edges 43 are closely adjacent the ends of the holes 29 so that the loop 51 is held securely. To remove one of the strips 19, the head 31 is folded about a longitudinal line and withdrawn through the slit 27.

Figure 5:
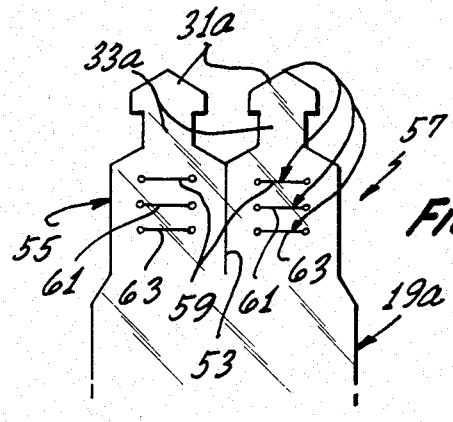
FIG. 5 is a fragmentary elevational view of a second form of flexible strip for an environmental curtain constructed in accordance with the teachings of this invention.

FIG. 5 shows a strip **19*a* which is identical to the strip 19 in all respects not shown or described herein. Portions of the strip 19 corresponding to portions of the strip 19*a*** are designated by corresponding reference numerals followed by the letter "a."

The strip **19*a* has a longitudinal slit 53 which divides the upper end portion of the strip 19*a* into two identical segments 55 and 57. Each of the segments 55 and 57 is identical to the upper end portion of the strip 19, except that it has an upper slit 59, an intermediate slit 61 and a lower slit 63. The head 31*a* can be inserted through any one of the slits 59, 61 or 63 as indicated by the arrows in FIG. 5 to thereby provide adjustability in the size of the loop that is formed. By appropriately spacing the slits 59, 61 and 63 longitudinally, the head 31*a* can, for example, be inserted completely through the slit 61 until its shoulders 41 are essentially aligned with the slit 61 and have its end portion received within the slit 63** to retain it in position.

Of course, more than two of the segments 55 and 57 may be provided if desired. The concept of utilizing multiple slits 59, 61 and 63 can be employed in the strip 19 of FIGS. 2–4. Also, only a single one of the slits 59, 61 and 63 may be utilized in the segments 55 and 57, if desired.

Figure 6:
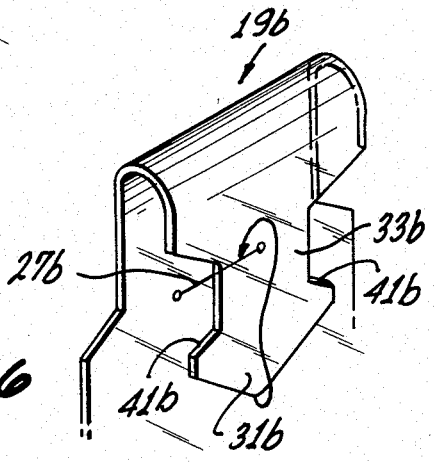
FIG. 6 is a fragmentary isometric view similar to FIG. 2 of a third form of flexible strip constructed in accordance with the teachings of this invention.

FIG. 6 shows a strip **19*b* which is identical to the strip 19 in all respects not shown or described herein. Portions of the strip 19*b* corresponding to portions of the strip 19** are designated by corresponding reference numerals followed by the letter "b."

The strip **19*b* is identical to the strip 19, except that the shoulders 41*b* are inclined so that they slope away from each other as they extend away from the neck 33*b***.

The incline of the shoulders 41*b* facilitates the withdrawal of the head 31*b* through the slit 27*b* by reducing the pulling force required to withdraw the head 31*b* from the slit 27*b*.

In the embodiment of FIGS. 1–3, the bar 21 is of generally rectangular cross-sectional configuration. In a typical installation, the bar 21 may be clamped against the wall 15 just above the opening 13 by threaded fasteners so that the back of the loops 51 are clamped against the wall. A strip construction in which the loops are openable or releasable in response to a predetermined pulling force on the flexible strip can more advantageously be utilized with the mounting construction of FIG. 4.

FIG. 4 shows an environmental curtain 11*c* which is identical to the environmental curtain 11 in all respects not shown or described herein. Portions of the environmental curtain 11*c* corresponding to portions of the environmental curtain 11 are designated by corresponding reference numerals followed by the letter "c."

The environmental curtain 11*c* is identical to the environmental curtain 11 in all respects, except for the manner in which the strips 19*c* are mounted on supporting structure 101. The supporting structure 101 includes two spaced vertical support members 103 (only one being shown in FIG. 4) and an upper horizontal support member 105. A "V" bracket 107 is rigidly mounted on the vertical support member 103 adjacent the upper end thereof by threaded fasteners, and a similar "V" bracket (not shown) is similarly mounted on the other vertical support member. The support members 103 and 105 cooperate to define an open region or opening 13*c* which the strips 19*c* (only one shown in FIG. 4) are adapted to close.

The curtain support is in the form of a cylindrical rod 21*c*, the opposite ends of which are supported on the "V" brackets 107 so that the rod 21*c* is supported closely adjacent the upper end of the opening 13*c* with the periphery of the rod 21*c* being in spaced relationship to the supporting structure 101. Thus, with the rod 21*c* projecting through the loops 51*c*, the loops are not clamped against the supporting structure 101. The pulling force on the strip 19*c* which is required to pull the head 31*c* out of the slit 27*c* is less than the force required to pull down the entire strip curtain 11*c*. For example, the slope on the shoulders 41*c* and/or other factors referred to herein can be selected to bring about this result. With this construction, the loop 51*c* will open in response to a pulling force before any other factor, such as breakage of the rod 21*c* or of the "V" brackets 107 will occur to bring about a pulling down of the entire strip curtain 11*c*.

A mounting construction utilizing a cylindrical rod 21*c* spaced from the supporting structure 101 is known per se and is illustrated herein because of the advantages obtainable when that structure is combined with the releasable means allowing opening of the loop 51*c* at a lesser pulling force on the strip 19*c* than is required to pull down the entire environmental curtain 11*c*. Of course, any of the flexible strips shown or described herein can be utilized in combination with the supporting structure of FIG. 4.

Although environmental curtains are shown and described herein, the invention is applicable to other kinds of strip curtains. Although exemplary embodiments of the invention have been shown and described, many changes, modifications and substitutions may be made by one having ordinary skill in the art without necessarily departing from the spirit and scope of this invention.

I claim:

1. A strip curtain attachable to supporting structure having an open region at least partially closable by the strip curtain, said strip curtain comprising:

a plurality of elongated flexible strips;

an elongated curtain support;

means for attaching the curtain support to the supporting structure adjacent the open region;

each of said strips having an upper end portion terminating in an upper end;

at least a portion of each of said upper end portions being formed into a loop, each of said loops receiving the curtain support whereby the flexible strips can be suspended from the curtain support in side-by-side relationship;

at least one of said upper end portions being on a first of said strips and including releasable means responsive to a pulling force of at least about a predetermined magnitude on the first strip for allowing at least the portion of said first strip below said upper end portion thereof to fall from the curtain support;

said predetermined force being less than the pulling force on said first strip which is required to pull the curtain support down from the attaching means;

said attaching means attaching the curtain support to the supporting structure with the curtain support being spaced over a major portion of its length from the supporting structure and said releasable means being responsive to a pulling force of about at least said predetermined magnitude on the first strip for opening the loop of said first strip whereby said first strip can fall from the curtain support; and an opening in said end portion of said first strip with the opening being spaced from said end of said first strip by a segment of said first strip and a head and a neck on said segment of said first strip, said neck being of less width than the head and being between the head and said opening of said first strip, said head being insertable through said opening of said strip to place the neck in said opening of said first strip to form at least a portion of said segment into the loop for said first strip, said head being wider than said opening of said first strip whereby the head must be distorted to insert the head through the opening of said first strip, and said releasable means including said head being withdrawable through said opening in response to a pulling force on said first strip of about said predetermined magnitude.

2. A strip curtain as defined in claim 1 wherein said opening includes a slit forming a major portion of said opening, said neck has generally parallel side edges which lie closely adjacent the opposite ends of the slit when the head is inserted through the opening to place the neck in said opening, said head terminating in said end of said first strip, said head has inclined edges sloping away from each other as they extend in a direction from said end toward said neck, said head has generally oppositely extending shoulders contiguous said neck, said head being wider at said shoulders than said opening.

* * * * *